US007385517B2

(12) United States Patent
Andres et al.

(10) Patent No.: US 7,385,517 B2
(45) Date of Patent: Jun. 10, 2008

(54) GATEWAY DEVICE TO INTERCONNECT SYSTEM INCLUDING LIFE SAFETY DEVICES

(75) Inventors: John J. Andres, Chapel Hill, NC (US); Matthew J. Buchholz, Canon City, CO (US); Stan Burnette, Colorado Springs, CO (US); Travis Silver, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 0 days.

(21) Appl. No.: 11/253,286

(22) Filed: Oct. 17, 2005

(65) Prior Publication Data

US 2006/0082461 A1 Apr. 20, 2006

Related U.S. Application Data

(60) Provisional application No. 60/620,226, filed on Oct. 18, 2004.

(51) Int. Cl.
*G08B 17/10* (2006.01)

(52) U.S. Cl. ..... 340/628; 340/506

(58) Field of Classification Search ..... 340/628, 340/506–508, 539.1, 539.14
See application file for complete search history.

(56) References Cited

U.S. PATENT DOCUMENTS

| | | | |
|---|---|---|---|
| 2,249,560 | A | 7/1941 | Howton |
| 2,566,121 | A | 8/1951 | Decker |
| 3,559,194 | A | 1/1971 | Bisberg |
| 3,909,826 | A | 9/1975 | Schildmeier et al. |
| 3,932,850 | A | 1/1976 | Conforti et al. |
| 4,020,479 | A | 4/1977 | Conforti et al. |
| 4,091,363 | A | 5/1978 | Siegel et al. |
| 4,097,851 | A | 6/1978 | Klein |
| 4,112,310 | A | 9/1978 | Malinowski |
| 4,138,664 | A | 2/1979 | Conforti et al. |
| 4,138,670 | A | 2/1979 | Schneider et al. |
| 4,139,846 | A | 2/1979 | Conforti |
| 4,160,246 | A | 7/1979 | Martin et al. |
| 4,178,592 | A | 12/1979 | McKee |
| 4,189,720 | A | 2/1980 | Lott |

(Continued)

FOREIGN PATENT DOCUMENTS

| | | |
|---|---|---|
| JP | 2-121093 | 5/1990 |

(Continued)

OTHER PUBLICATIONS

Invensys Climate ControlsInvensys Launch Firex® 7000 Combination Smoke and Carbon Monoxide Alarm, 2 pages (Oct. 16, 2003).

(Continued)

*Primary Examiner*—Benjamin C. Lee
*Assistant Examiner*—Shirley Lu
(74) *Attorney, Agent, or Firm*—Merchant & Gould P.C.

(57) ABSTRACT

A life safety device can include a sensor configured to sense a hazardous condition, an interconnect module configured to communicate the hazardous condition to a wired life safety device using one or more wires, and a transceiver module configured to wirelessly communicate the hazardous condition to a wireless life safety device.

8 Claims, 7 Drawing Sheets

U.S. PATENT DOCUMENTS

| | | | | |
|---|---|---|---|---|
| 4,204,201 | A | 5/1980 | Williams et al. | |
| 4,225,860 | A | 9/1980 | Conforti | |
| 4,232,308 | A | 11/1980 | Lee et al. | |
| 4,258,261 | A | 3/1981 | Conforti | |
| 4,284,849 | A | 8/1981 | Anderson et al. | |
| 4,287,517 | A | 9/1981 | Nagel | |
| 4,302,753 | A | 11/1981 | Conforti | |
| 4,363,031 | A | 12/1982 | Reinowitz | |
| 4,517,555 | A | 5/1985 | Marsocci et al. | |
| 4,531,114 | A * | 7/1985 | Topol et al. | 340/539.1 |
| 4,556,873 | A | 12/1985 | Yamada et al. | |
| 4,581,606 | A | 4/1986 | Mallory | |
| 4,583,072 | A | 4/1986 | Matsushita | |
| 4,594,581 | A | 6/1986 | Matoba | |
| 4,647,219 | A | 3/1987 | Figler et al. | |
| 4,692,750 | A | 9/1987 | Murakami et al. | |
| 4,737,770 | A | 4/1988 | Brunius et al. | |
| 4,772,876 | A | 9/1988 | Laud | |
| 4,788,530 | A | 11/1988 | Bernier | |
| 4,801,924 | A | 1/1989 | Burgmann et al. | |
| 4,814,748 | A | 3/1989 | Todd | |
| 4,827,244 | A | 5/1989 | Bellavia et al. | |
| 4,829,283 | A | 5/1989 | Spang et al. | |
| 4,845,474 | A | 7/1989 | Moore et al. | |
| 4,855,713 | A | 8/1989 | Brunius | |
| 4,859,990 | A | 8/1989 | Isaacman | |
| 4,870,395 | A | 9/1989 | Belano | |
| 4,884,065 | A | 11/1989 | Crouse et al. | |
| 4,901,056 | A | 2/1990 | Bellavia et al. | |
| 4,904,988 | A | 2/1990 | Nesbit et al. | |
| 4,951,029 | A | 8/1990 | Severson | |
| 4,965,556 | A | 10/1990 | Brodecki et al. | |
| 4,992,965 | A | 2/1991 | Hölter et al. | |
| 5,034,725 | A | 7/1991 | Sorensen | |
| 5,063,164 | A | 11/1991 | Goldstein | |
| 5,066,466 | A | 11/1991 | Hölter et al. | |
| 5,077,547 | A | 12/1991 | Burgmann | |
| 5,095,300 | A | 3/1992 | Alexander et al. | |
| 5,103,216 | A | 4/1992 | Sisselman | |
| RE33,920 | E | 5/1992 | Tanguay et al. | |
| 5,122,782 | A | 6/1992 | Kawahara | |
| 5,132,958 | A | 7/1992 | Camps et al. | |
| 5,132,968 | A | 7/1992 | Cephus | |
| 5,159,315 | A | 10/1992 | Schultz et al. | |
| 5,172,096 | A | 12/1992 | Tice et al. | |
| 5,177,461 | A | 1/1993 | Budzyna et al. | |
| 5,252,949 | A | 10/1993 | Kirby et al. | |
| 5,280,273 | A | 1/1994 | Goldstein | |
| 5,285,792 | A | 2/1994 | Sjoquist et al. | |
| 5,289,165 | A | 2/1994 | Belin | |
| 5,317,305 | A | 5/1994 | Campman | |
| 5,386,209 | A | 1/1995 | Thomas | |
| 5,408,217 | A | 4/1995 | Sanderford, Jr. | |
| 5,422,629 | A | 6/1995 | Minnis | |
| 5,440,293 | A | 8/1995 | Tice | |
| 5,442,336 | A | 8/1995 | Murphy et al. | |
| 5,444,434 | A | 8/1995 | Serby | |
| 5,473,167 | A | 12/1995 | Minnis | |
| 5,481,259 | A | 1/1996 | Bane | |
| 5,483,222 | A | 1/1996 | Tice | |
| 5,500,639 | A | 3/1996 | Walley et al. | |
| 5,517,182 | A | 5/1996 | Yasunaga | |
| 5,574,436 | A | 11/1996 | Sisselman et al. | |
| 5,578,996 | A | 11/1996 | Watson et al. | |
| 5,587,705 | A | 12/1996 | Morris | |
| 5,594,410 | A | 1/1997 | Lucas et al. | |
| 5,594,422 | A | 1/1997 | Huey, Jr. et al. | |
| 5,621,394 | A | 4/1997 | Garrick et al. | |
| 5,663,714 | A | 9/1997 | Fray | |
| 5,666,331 | A | 9/1997 | Kollin | |
| 5,682,145 | A | 10/1997 | Sweetman et al. | |
| 5,686,885 | A | 11/1997 | Bergman | |
| 5,686,896 | A | 11/1997 | Bergman | |
| 5,694,118 | A | 12/1997 | Park et al. | |
| 5,705,979 | A | 1/1998 | Fierro et al. | |
| 5,748,079 | A | 5/1998 | Addy | |
| 5,764,150 | A | 6/1998 | Fleury et al. | |
| 5,774,038 | A | 6/1998 | Welch et al. | |
| 5,781,143 | A | 7/1998 | Rossin | |
| 5,786,768 | A | 7/1998 | Chan et al. | |
| 5,793,296 | A | 8/1998 | Lewkowicz | |
| 5,801,633 | A | 9/1998 | Soni | |
| 5,808,551 | A | 9/1998 | Yarnall, Jr. et al. | |
| 5,812,617 | A | 9/1998 | Heckman et al. | |
| 5,815,066 | A | 9/1998 | Pumilia | |
| 5,815,075 | A | 9/1998 | Lewiner et al. | |
| 5,818,334 | A | 10/1998 | Stanley | |
| 5,831,526 | A | 11/1998 | Hansler et al. | |
| 5,848,062 | A | 12/1998 | Ohno | |
| 5,857,146 | A | 1/1999 | Kido | |
| 5,867,105 | A | 2/1999 | Hajel | |
| 5,889,468 | A | 3/1999 | Banga | |
| 5,898,369 | A | 4/1999 | Goodwin | |
| 5,905,438 | A | 5/1999 | Weiss et al. | |
| 5,907,279 | A | 5/1999 | Bruins et al. | |
| 5,914,656 | A | 6/1999 | Ojala et al. | |
| 5,949,332 | A | 9/1999 | Kim | |
| 5,969,600 | A | 10/1999 | Tanguay | |
| 5,977,871 | A | 11/1999 | Miller et al. | |
| 6,028,513 | A | 2/2000 | Addy | |
| 6,044,359 | A | 3/2000 | Goodwin, III | |
| 6,049,273 | A | 4/2000 | Hess | |
| 6,054,920 | A | 4/2000 | Smith et al. | |
| 6,078,269 | A | 6/2000 | Markwell et al. | |
| 6,081,197 | A | 6/2000 | Garrick et al. | |
| 6,084,522 | A | 7/2000 | Addy | |
| 6,111,872 | A | 8/2000 | Suematsu et al. | |
| 6,114,955 | A | 9/2000 | Brunius et al. | |
| 6,133,839 | A | 10/2000 | Ellul, Jr. et al. | |
| 6,144,289 | A | 11/2000 | Le Bel | |
| 6,144,310 | A | 11/2000 | Morris | |
| 6,150,936 | A | 11/2000 | Addy | |
| 6,172,612 | B1 | 1/2001 | Odachowski | |
| 6,188,715 | B1 | 2/2001 | Partyka | |
| 6,208,253 | B1 | 3/2001 | Fletcher et al. | |
| 6,229,449 | B1 | 5/2001 | Kirchner et al. | |
| 6,243,010 | B1 | 6/2001 | Addy et al. | |
| 6,292,108 | B1 | 9/2001 | Straser et al. | |
| 6,301,514 | B1 | 10/2001 | Canada et al. | |
| 6,307,482 | B1 | 10/2001 | Le Bel | |
| 6,323,780 | B1 | 11/2001 | Morris | |
| 6,353,395 | B1 | 3/2002 | Duran | |
| 6,380,860 | B1 | 4/2002 | Goetz | |
| 6,384,724 | B1 | 5/2002 | Landais | |
| 6,414,599 | B1 | 7/2002 | Hsieh | |
| 6,420,973 | B2 | 7/2002 | Acevedo | |
| 6,441,723 | B1 | 8/2002 | Mansfield, Jr. et al. | |
| 6,445,291 | B2 | 9/2002 | Addy et al. | |
| 6,445,292 | B1 | 9/2002 | Jen et al. | |
| 6,492,907 | B1 | 12/2002 | McCracken | |
| 6,529,128 | B2 | 3/2003 | Weng | |
| 6,577,242 | B2 | 6/2003 | Jen et al. | |
| 6,600,424 | B1 | 7/2003 | Morris | |
| 6,611,204 | B2 | 8/2003 | Schmurr | |
| 6,624,750 | B1 | 9/2003 | Marman et al. | |
| 6,624,760 | B1 | 9/2003 | Kinzel et al. | |
| 6,642,849 | B1 | 11/2003 | Kondziolka | |
| 6,693,532 | B2 | 2/2004 | Capowski et al. | |
| 6,756,896 | B2 * | 6/2004 | Ford | 340/506 |
| 6,762,688 | B2 | 7/2004 | Johnston et al. | |
| 6,791,453 | B1 | 9/2004 | Andres et al. | |
| 2001/0024163 | A1 | 9/2001 | Petite | |
| 2001/0038336 | A1 | 11/2001 | Acevedo | |
| 2001/0038337 | A1 | 11/2001 | Wickstead et al. | |

| | | | |
|---|---|---|---|
| 2001/0043144 | A1 | 11/2001 | Morris |
| 2002/0021223 | A1 | 2/2002 | Jen et al. |
| 2002/0047774 | A1 | 4/2002 | Christensen et al. |
| 2002/0080039 | A1 | 6/2002 | Vining |
| 2002/0093430 | A1 | 7/2002 | Goodwin |
| 2002/0093439 | A1 | 7/2002 | Lundin et al. |
| 2002/0126016 | A1 | 9/2002 | Sipp |
| 2002/0130782 | A1 | 9/2002 | Johnston et al. |
| 2002/0145513 | A1 | 10/2002 | Ropke |
| 2002/0158764 | A1 | 10/2002 | Conway |
| 2002/0163428 | A1 | 11/2002 | Weng |
| 2002/0171544 | A1* | 11/2002 | Schmurr ..... 340/538 |
| 2002/0175811 | A1 | 11/2002 | Merrell et al. |
| 2003/0031140 | A1 | 2/2003 | Oprescu-Surcobe et al. |
| 2003/0052770 | A1 | 3/2003 | Mansfield, Jr. et al. |
| 2003/0058114 | A1 | 3/2003 | Miller et al. |
| 2003/0080865 | A1 | 5/2003 | Capowski et al. |
| 2003/0090375 | A1 | 5/2003 | Addy et al. |
| 2003/0179096 | A1 | 9/2003 | Hanan |
| 2003/0210138 | A1 | 11/2003 | Farley |
| 2003/0227387 | A1 | 12/2003 | Kimberlain et al. |
| 2003/0230415 | A1 | 12/2003 | Wilson et al. |

FOREIGN PATENT DOCUMENTS

| | | |
|---|---|---|
| JP | 3-30096 | 2/1991 |
| JP | 3-240198 | 10/1991 |
| JP | 3-276393 | 12/1991 |
| JP | 4-10194 | 1/1992 |
| JP | 4-57197 A | 2/1992 |
| JP | 5-210790 | 8/1993 |
| JP | 7-6283 | 1/1995 |
| JP | 7-65268 | 3/1995 |
| JP | 8-751 | 1/1996 |
| JP | 10-11680 | 1/1998 |
| JP | 11-86160 | 3/1999 |
| JP | 2002-216261 | 8/2002 |
| JP | 2002-216262 | 8/2002 |
| WO | WO 92/10820 | 6/1992 |
| WO | WO 94/03881 | 2/1994 |
| WO | WO 02/084620 A1 | 10/2002 |

OTHER PUBLICATIONS

AICO, Radiolink, 6 pages (Sep. 23, 2004).

* cited by examiner

GATEWAY DEVICE TO INTERCONNECT SYSTEM INCLUDING LIFE SAFETY DEVICES

RELATED APPLICATION

This application claims the benefit of U.S. Patent Provisional Application Ser. No. 60/620,226 filed on Oct. 18, 2004, the entirety of which is hereby incorporated by reference.

TECHNICAL FIELD

The disclosed technology relates to a system of life safety devices. More particularly, the disclosed technology relates to a hybrid wired and wireless system including life safety devices.

BACKGROUND

It is known to use life safety devices within a building or other structure to detect various hazardous conditions and provide a warning to occupants of the building of the detected hazardous condition. Examples of well-known life safety devices include smoke detectors and carbon monoxide detectors. Many life safety devices include both the capability to detect a hazardous condition, for example smoke, and to generate an audible and/or visual alarm to provide an alert that a hazardous condition has been detected. Other life safety devices are configured to detect a hazardous condition, and when a hazardous condition is detected, send a signal to a remote alarm device that generates the alarm. In each case, a hazardous condition is detected and an alarm is generated warning of the hazardous condition.

In typical systems, the life safety devices can be interconnected to one another using one or more wires. See, for example, U.S. Pat. No. 6,791,453 to Andres et al., the entirety of which is hereby incorporated by reference. In U.S. Pat. No. 6,791,453, a system includes a plurality of devices connected to one another by wires used to provide power and facilitate communication between each device. With a system configured in this manner, if a hazardous condition is detected by one device located in one part of a building, the device can communicate the hazardous condition through the wires to devices located in other parts of the building to cause those devices to generate a warning to alert occupants of the hazardous condition.

While systems such as that disclosed in U.S. Pat. No. 6,791,453 are advantageous in that the systems can alert occupants throughout a building of a hazardous condition, the systems can be disadvantageous in that they require wires to be run between each device in the systems to allow for communications between devices. Such systems can be economically installed in new construction, but it can be costly and time-consuming to install the wiring required for these systems in existing construction.

Attempts to remedy this problem include systems with devices that communicate with one another via wireless technologies such as radio frequency (RF) signals, in which the device that detects a hazardous condition sends an RF signal to other devices in the building, thereby triggering a warning on those devices. See, for example, U.S. Pat. Nos. 5,587,705; and 5,898,369. The use of RF interconnected life safety devices can be attractive, as an existing building, for example a home, can be equipped with the safety devices without the need to run new wiring throughout the building.

However, when a device needs to be added in a building having an existing system of wired life safety devices: (i) the new device must be wired to the existing system of wired detectors to allow the new device to communicate with the existing system; or (ii) the entire system of wired devices must be replaced with wireless devices to allow for wireless communication between the devices.

It is therefore desirable to provide systems that allow for a hybrid of wired and wireless interconnections between devices of the systems.

SUMMARY

The disclosed technology relates to a system of life safety devices. More particularly, the disclosed technology relates to a hybrid wired and wireless system including life safety devices.

According to one aspect, a life safety device can include a sensor configured to sense a hazardous condition. The device can include an interconnect module configured to communicate the hazardous condition to a wired life safety device using one or more wires. The device can also include a transceiver module configured to wirelessly communicate the hazardous condition to a wireless life safety device.

According to another aspect, a system including a plurality of life safety devices can include a plurality of wired life safety devices configured to sense a hazardous condition, wherein each of the wired life safety devices is connected to one or more of the other wired life safety devices using one or more wires, and wherein each of the wired life safety devices communicates with one or more of the other wired life safety devices using the wires. The system can include at least one wireless life safety device configured to sense the hazardous condition. The system can also include a gateway life safety device configured to sense the hazardous condition, wherein the gateway life safety device is wired to at least one of the wired life safety devices, and wherein the gateway life safety device communicates with one or more of the wired life safety devices using the wires, and wherein the gateway life safety device communicates wirelessly with the wireless life safety device. The wired life safety devices communicate with the wireless life safety device through the gateway life safety device.

According to yet another aspect, a method of creating wireless capability for an existing system of wired life safety devices, wherein each of the wired life safety devices is wired to one or more of the other wired life safety devices using one or more wires, can include: wiring a gateway life safety device to the system of wired life safety devices; allowing the gateway life safety device to communicate with the wired life safety devices using the wires; and allowing the gateway life safety device to wirelessly communicate with a wireless life safety device.

DETAILED DESCRIPTION

As used herein, the term "wired" means one or more electrical wires that are used to interconnect and allow communication between two or more devices. As used herein, the term "wireless" means the use of technologies such as, for example, radio frequency (RF), infrared, and/or ultrasonic, to connect and allow communication between two or more devices without requiring a wired connection.

Figure 1:
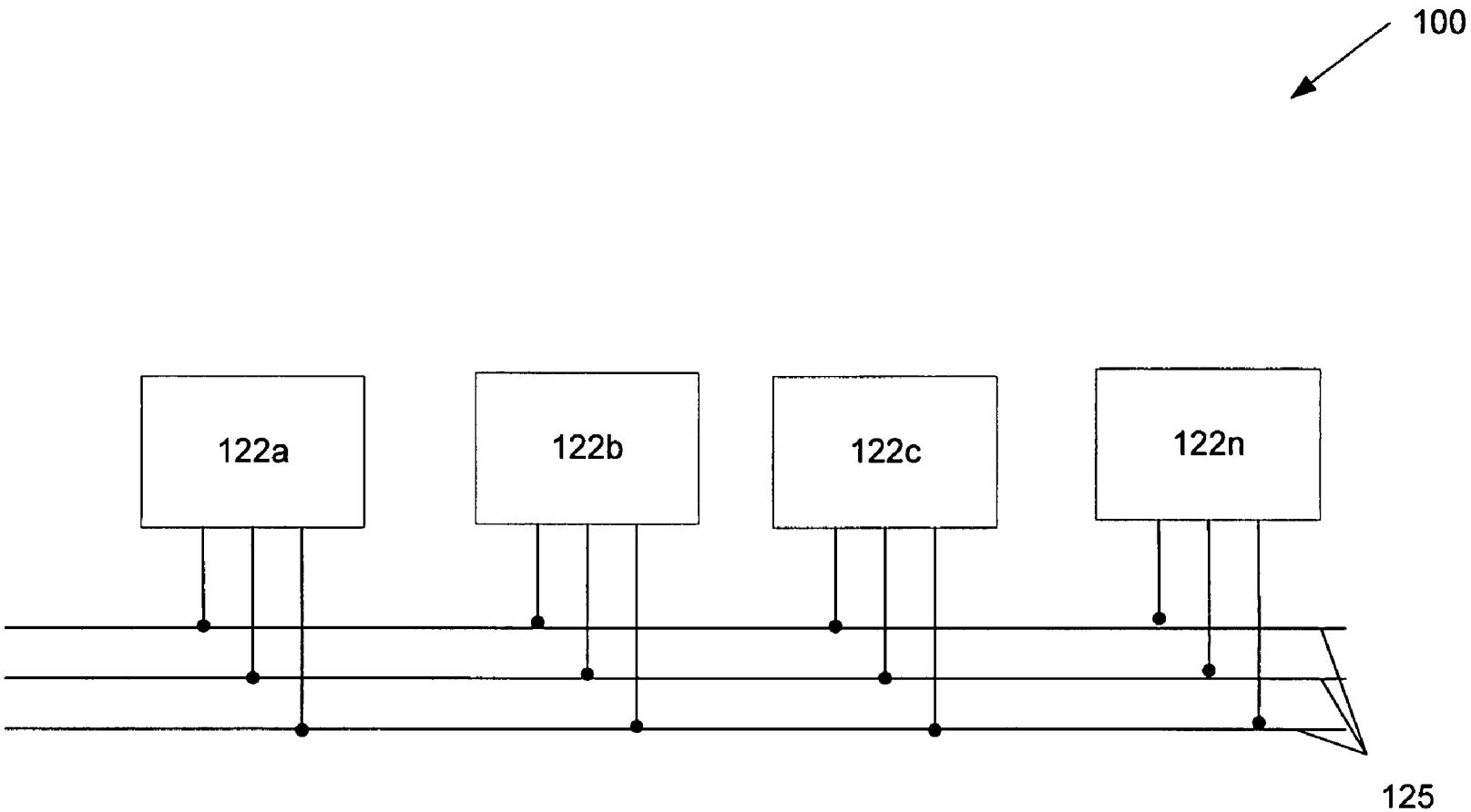
FIG. 1 illustrates an example system including a plurality of wired life safety devices.

An example embodiment of a system 100 of life safety devices is illustrated in FIG. 1. The system 100 is composed of a plurality of wired hazardous condition detectors 122*a*, 122*b*, 122*c* . . . 122*n*. (Other non-detecting devices such as, for example, a device that generates an alarm upon receiving a signal from a detecting device can also be included.) The detectors 122*a*, 122*b*, 122*c* . . . 122*n* are connected to one another by one or more wires 125. Wires 125 are used to allow detectors 122*a*, 122*b*, 122*c* . . . 122*n* to communicate with one another over wires 125, thereby creating a wired system of interconnected detectors. Wires 125 can also be used for other purposes such as, for example, providing power to each detector. See U.S. Pat. No. 6,791,453, which discloses a three-wire interconnect including two wires for power and a signal wire.

The hazardous condition detectors 122*a*, 122*b*, 122*c* . . . 122*n* can be distributed at suitable locations within a building for detecting hazardous conditions throughout the building. For example, if the building is a home, the detectors can be located in the various rooms of the home, including the kitchen, the basement, the bedrooms, etc.

The hazardous condition detectors 122*a*, 122*b*, 122*c* . . . 122*n* can include, but are not limited to, smoke detectors, heat detectors, gas detectors for detecting carbon monoxide gas, natural gas, propane, methane, and other toxic gas, fire/flame detectors, and combinations thereof. The detectors are preferably configured to be able to detect a hazardous condition. The detectors are also preferably configured to be able to produce an alarm when a hazardous condition is detected. The alarm produced by the detector can be an audible alarm, a visual alarm, or a combination thereof. The detectors can be battery powered (DC), can be mains powered (AC), or can be mains powered with battery backup (AC/DC).

For sake of convenience, the hazardous condition detectors will hereinafter be described and referred to as smoke detectors that produce an audible alarm.

Referring now to FIG. 2, system 100 is again illustrated. Detector 122*c* has been replaced with an example embodiment of a gateway device 222*c*. Gateway device 222*c* is similar to detectors 122*a*, 122*b* . . . 122*n* and is wired to detectors 122*b* and 122*n*. However, gateway device 222*c* includes the capability to communicate wirelessly with one or more detectors.

Figure 3:
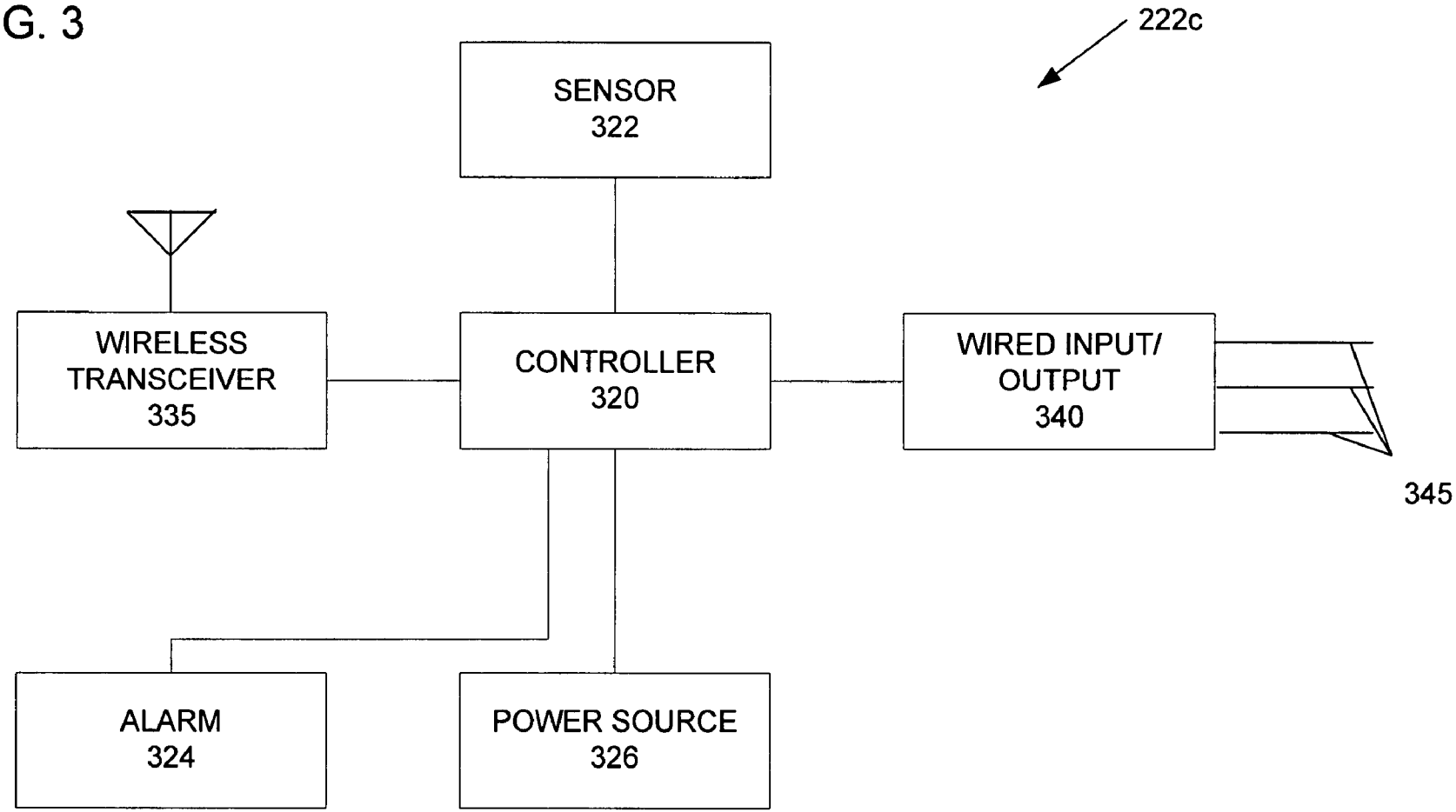
FIG. 3 is an example block diagram of the gateway life safety device of FIG. 2.

Referring now to FIG. 3, the example gateway device 222*c* is illustrated. Gateway device 222*c* comprises a controller 320 that is preferably a microprocessor. Detector 222*c* also includes a suitable smoke sensor 322 that is connected to the controller 320 for providing a signal relating to the level of smoke detected. The sensor 322 can be an ionization smoke sensor or a photoelectric smoke sensor of a type known in the art. Upon a sufficient level of smoke being sensed by sensor 322, the controller 320 sends a signal to an alarm 324, for example an alarm horn, to trigger the alarm. Power for the controller 320, the sensor 322, the alarm 324 and the other components of the detector 322 is provided by a power source 326 (e.g., a battery or source of AC power).

Figure 2:
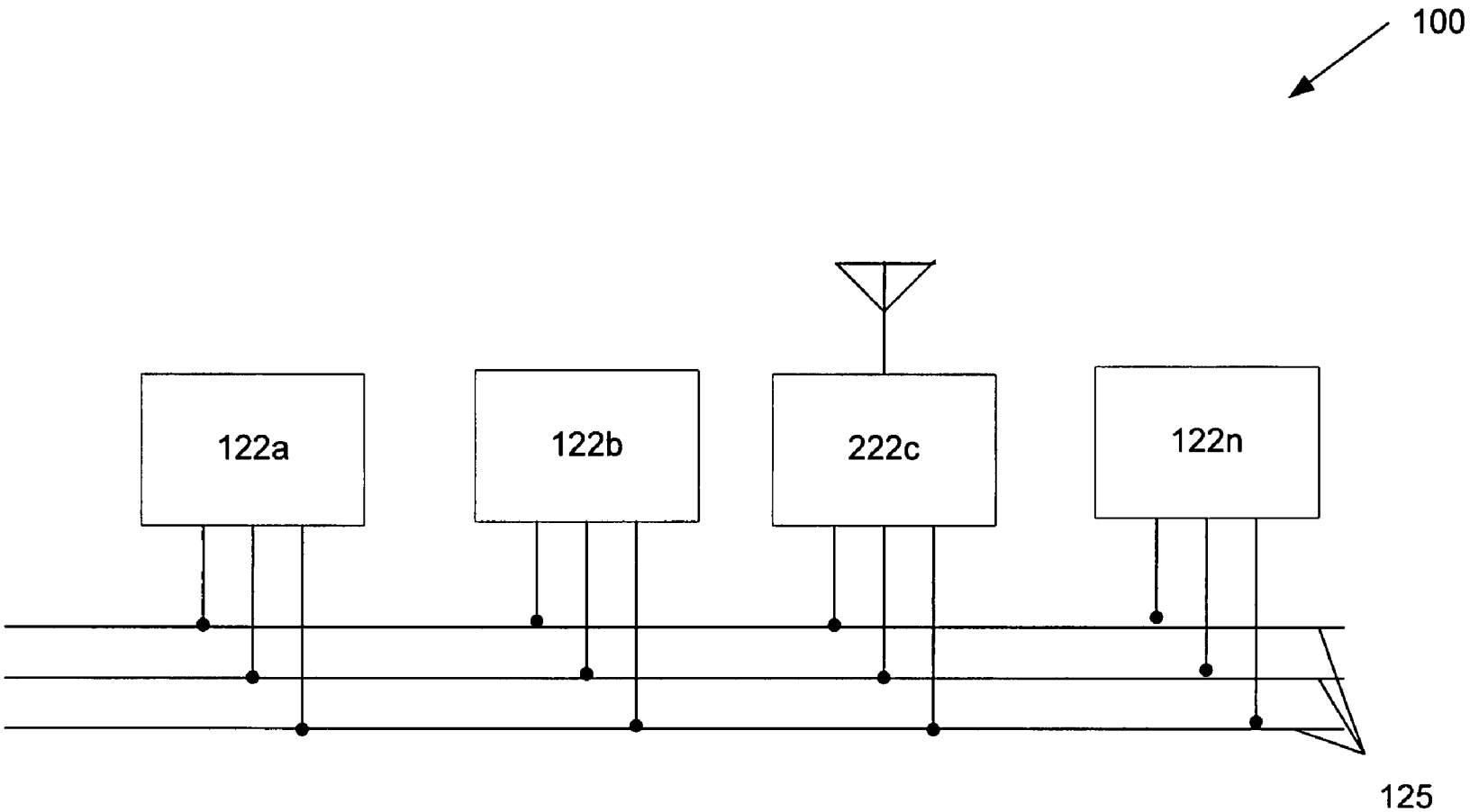
FIG. 2 illustrates the system of FIG. 1 including an example gateway life safety device.

The detector 222*c* includes wired input/output 340. Wired input/output 340 allows the detector 222*c* to be coupled to and communicate with one or more additional detectors using one or more wires 345. For example, as shown in FIG. 2, the gateway device 222*c* is coupled to detectors 122*b* and 122*n* by the wires 125.

Referring back to FIG. 3, the detector 222*c* also includes an RF transceiver 335 that wirelessly transmits and receives coded RF signals to/from remote detectors. This allows detector 222*c* to be coupled to and communicate with one or more detectors wirelessly. For example, detector 222*c* can utilize one or more RF communication schemes as described in U.S. Patent Provisional Application Ser. No. 60/620,227 filed on Oct. 18, 2004, and U.S. Patent Provisional Application Ser. No. 60/623,978 filed on Nov. 1, 2004, the entireties of which are hereby incorporated by reference.

In this manner, the gateway device 222*c* is a hybrid detector in that the detector can communicate through wires using wired input/output 340, and wirelessly using wireless transceiver 325.

Figure 4:
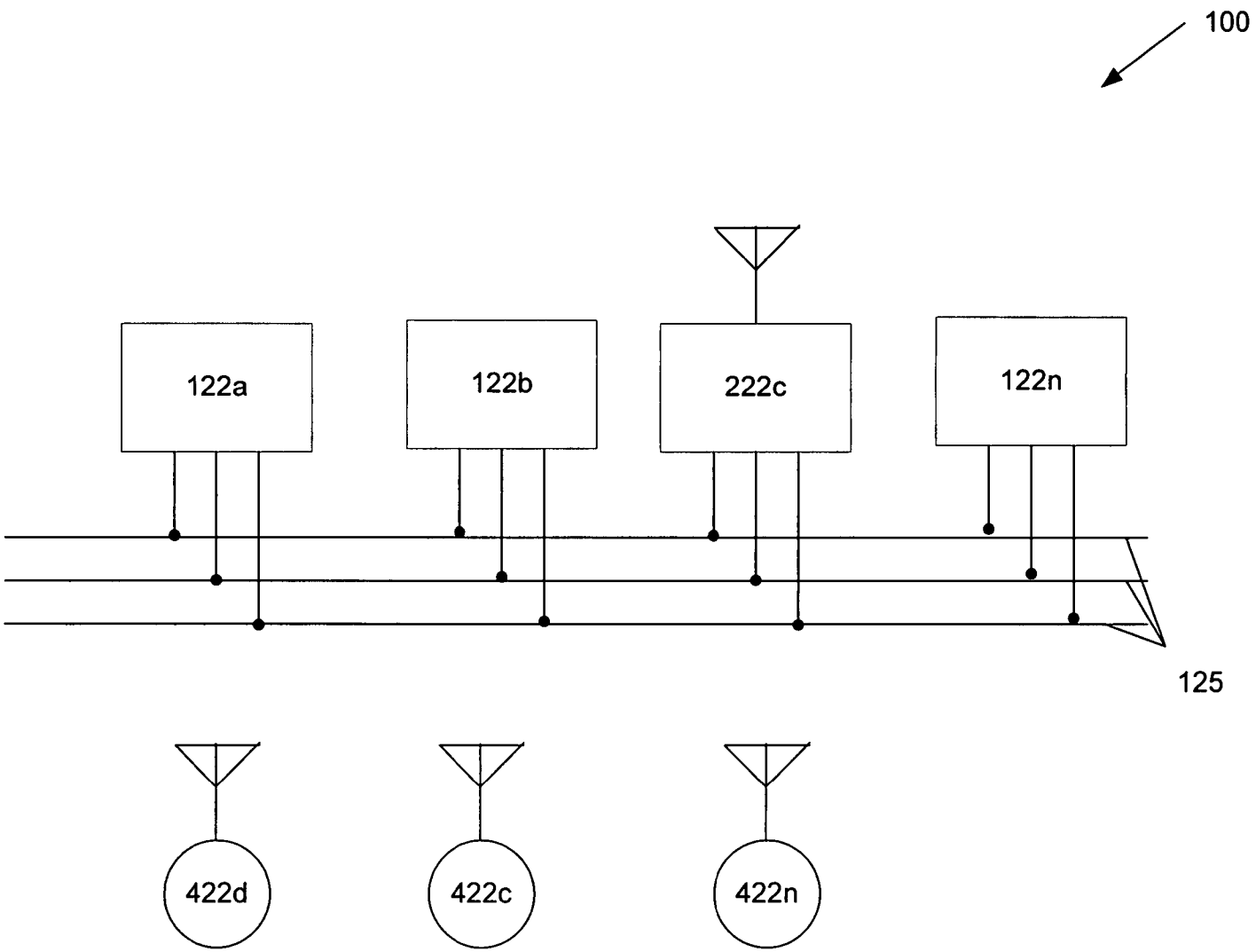
FIG. 4 illustrates the system of FIG. 2 including a plurality of example wireless life safety devices.

Referring now to FIG. 4, system 100 is again shown including gateway 222*c*. Also included are wireless hazardous condition detectors 422*d*, 422*e* . . . 422*n*. Wireless detectors 422*d*, 422*e* . . . 422*n* are similar to detectors 122*a*, 122*b*, 122*c* . . . 122*n* described above, except that detectors 422*d*, 422*e* . . . 422*n* communicate with each other wirelessly.

Detectors 422*d*, 422*e* . . . 422*n* can also wirelessly communicate with the wireless transceiver 335 of the gateway device 222*c*. Detectors 422*d*, 422*e* . . . 422*n* can indirectly communicate with detectors 122*a*, 122*b* . . . 122*n* through wireless communication with gateway device 222*c*, as described below.

In this manner, the gateway device 222*c* acts as a bridge that allows the wired portion of system 100 (i.e., detectors 122*a*, 122*b* . . . 122*n*) to communicate with the wireless portion (i.e., detectors 422*d*, 422*e* . . . 422*n*) and vice versa.

Figure 5:
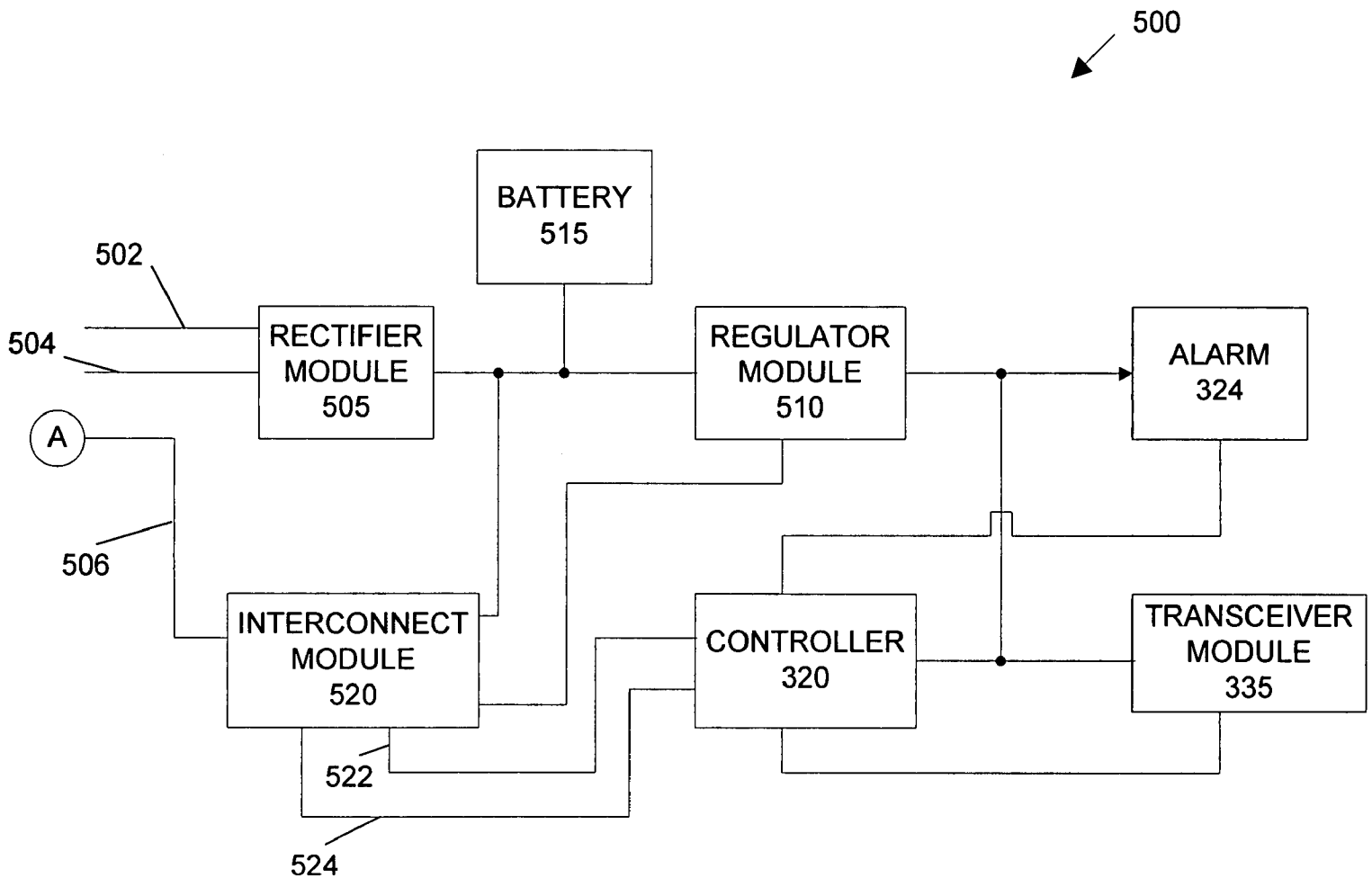
FIG. 5 is an example block diagram of another gateway life safety device.
Figure 6:
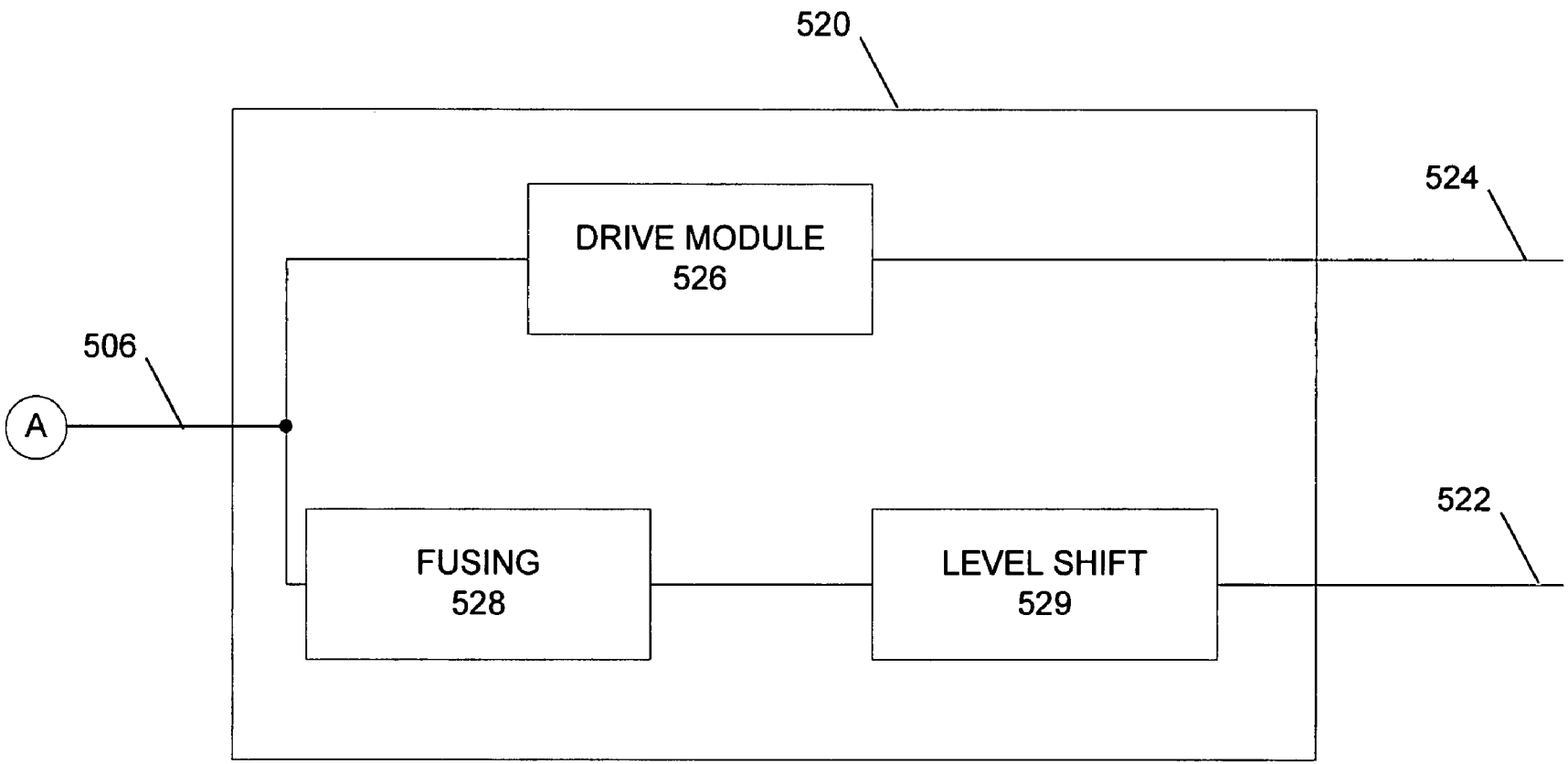
FIG. 6 is an example block diagram of an interconnect module of the gateway life safety device of FIG. 5.

Referring now to FIGS. 5 and 6, another example gateway device 500 is shown. Gateway device 500 includes a rectifier module 505, a regulator module 510, a battery 515, an interconnect module 520, controller 320, alarm 324, and transceiver 335. Generally, gateway device 500 can be connected to a system of wired interconnected detectors by wires 502, 504, and 506, as well as a system of wireless interconnected detectors by transceiver 335.

Rectifier module 505 of gateway device 500 is connected to the AC wires 502 and 504 of the interconnect between the wired detectors (e.g., wires 125 and/or 345 described above). Rectifier module 505 is connected to and provides rectified unregulated power (typically 7.5 to 15 volts) to interconnect module 520 and regulator module 510. Regulator module 510 is connected to interconnect module 520, alarm 324, and transceiver 335 to provide regulated rectified power, typically approximately 5 volts DC. Rectifier module 505 is also connected to battery 515. If power from wires 502 and 504 drops below a threshold level such as, for example 5 volts, battery 515 can provide up to 5 volts of power as a backup power source.

Interconnect module 520 is connected to wire 506 that is the signaling wire for the wired interconnect system. Interconnect module 520 is also connected to controller 320 by input wire 522 and output wire 524.

As shown in FIG. 6, interconnect module 520 includes a drive module 526, fusing 528, and level shift 529. Drive module 526 is a high impedance circuit so that wire 506 is typically connected to controller 320 by input wire 522. In the example shown, fusing 528 of interconnect module 520 is a resistor that is used to regulate the power provided on wire 506 to interconnect module 520. Fusing 528 is coupled to level shift 529 that shifts the voltage provided on wire 506 (typically 7.5 to 15 volts) to approximately 5 volts. Output of level shift 529 is connected to controller 320 by input wire 522.

Referring again to FIG. 5, output wire 524 is connected from controller 320 to drive module 526 of interconnect module 524. When controller 320 pulls drive module 526 high, unregulated voltage (approximately 7.5 to 15 volts) is provided by drive module 526 on wire 506.

In this configuration, interconnect module 520 connects controller 320 to the system of wired interconnected detectors. Specifically, any signal on wire 506 from the system of wired interconnected detectors is regulated and level shifted and provided to controller 320 by input wire 522. For example, in one example system, the voltage on wire 506 is typically approximately 0 volts until an alarm condition is detected by a wired detector, at which time the wired detector pulls the voltage on wire 506 to approximately 7.5 to 15 volts. Controller 320 can identify the increase in voltage provided at input wire 522 and use transceiver 335 to communicate the alarm condition to any wireless detectors.

In a similar manner, if controller 320 receives an alarm condition from a wireless detector using transceiver 335, controller 320 can pull drive module 526 of interconnect module 520 high, which in turn causes the voltage on wire 506 to go to approximately 7.5 to 15 volts, thereby signaling the alarm condition to the system of wired detectors connected to wire 506.

In another example, if gateway device 500 detects an alarm condition, it can transmit the alarm condition to any wireless detectors using transceiver 335, as well as transmit the alarm condition to any wired detectors through interconnect module 520 and wire 506.

Figure 7:
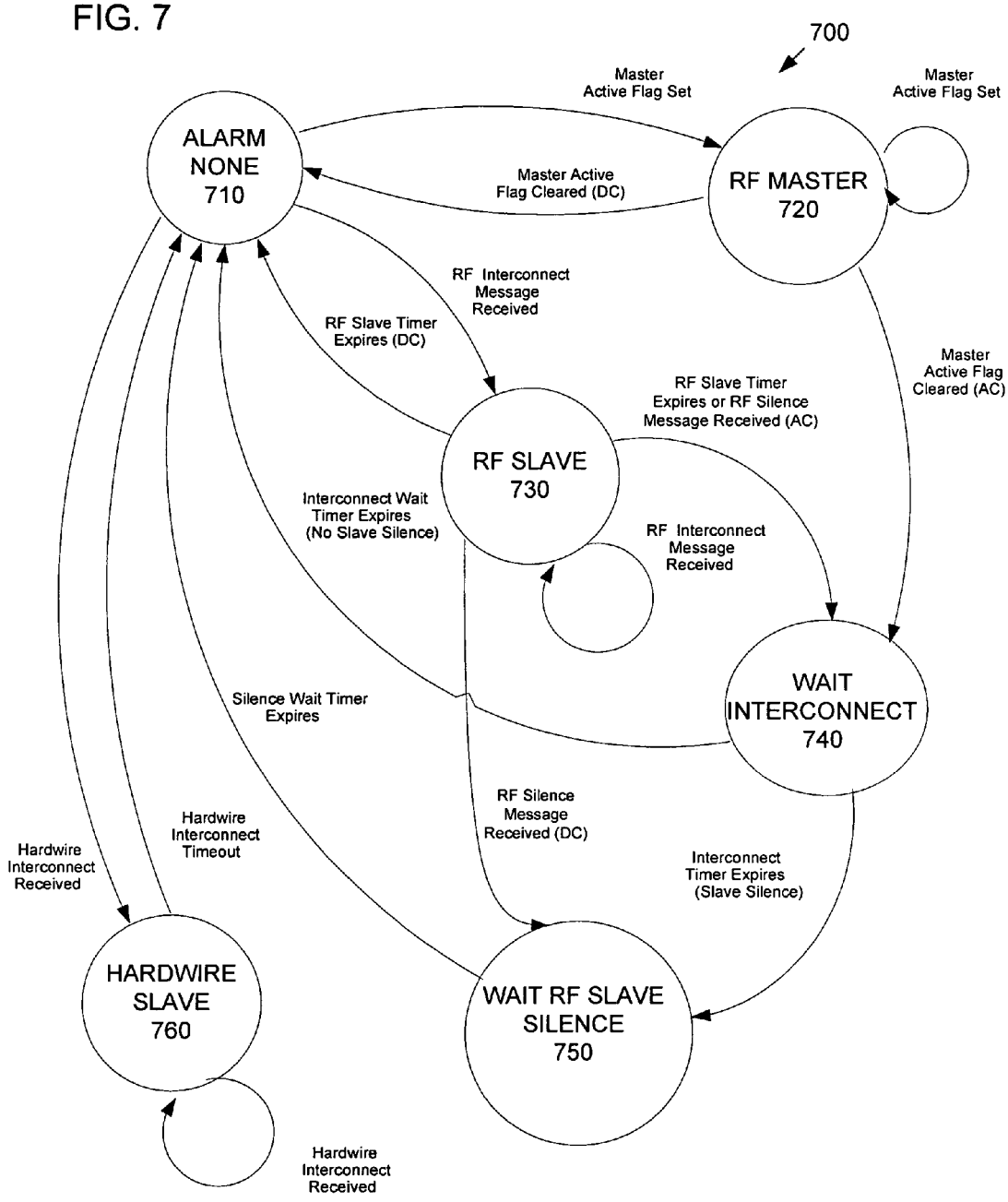
FIG. 7 is an example flow chart illustrating operations of a gateway life safety device.

Referring now to FIG. 7, an example flow chart 700 illustrates modes of an example gateway device, such as devices 222*c* and 500 described above. Generally, flow chart 700 illustrates the priority the gateway device gives to the different signals (wired or wireless) the device receives depending on the mode in which the device is current operating.

Initially, the gateway device is in an alarm none mode 710, in which the device senses hazardous conditions and waits for communications from wired or wireless devices. The gateway device remains in the alarm none mode 710 until the device either receives a signal from a wired or wireless detector, or until the device senses a hazardous condition. If the gateway device does sense a hazardous condition, the device enters a RF master mode 720. In the RF master mode 720, the device alarms and sends out alarm signals (wired and/or wireless) to any wired and/or wireless detectors. The device remains in RF master mode 720 until the device no longer senses the hazardous condition, at which time the device enters either (i) the alarm none mode 710 if the device is battery powered (DC), or (ii) a wait interconnect mode 740 if the device is AC powered.

With the gateway device in the alarm none mode 710, if the device receives a signal on the wired input (i.e., a hardwire interconnect signal), the device enters a hardwire slave mode 760. In the hardwire slave mode 760, the device alarms and sends out an RF alarm signal to any wireless detectors. The device remains in the hardwire slave mode 760 until the hardwire interconnect signal times out, at which time the device again enters the alarm none mode 710.

With the gateway device in the alarm none mode 710, if the device receives a signal on the wireless transceiver (i.e., an RF interconnect signal), the device enters an RF slave mode 730. In the RF slave mode 730, the device alarms and sends out a wired alarm signal to any wired detectors. If the device is AC powered, the device remains in the RF slave mode 730 until the RF interconnect signal times out or a silence message is received, at which time the device enters the wait interconnect mode 740. If the device is battery powered, the device remains in the RF slave mode 730 until (i) the RF interconnect signal times out, at which time the device enters the alarm none mode 710, or (ii) a silence message is received, at which time the device enters a wait RF slave silence mode 750.

In the wait interconnect mode 740, the device waits for a period of time to allow for the removal of the alarm signal on the interconnect line (e.g., to allow the interconnect line to drop to approximately ground). Once the interconnect wait period expires, the device enters either (i) the alarm none mode 710 if the device is not presently in a period of silence, or (ii) the wait RF slave silence mode 750 if the device is presently in a period of silence.

In the wait RF slave silence mode 750 (i.e., silence being a period of time during which the sensor of the device is desensitized and the alarm is silenced at the request of the user), the device waits a period of time to allow RF slave transmission to cease. Once the silence period expires, the device again enters the alarm none mode 710.

An example method of use of a system such as system 100 is as follows. Initially, a system of wired life safety devices is installed in a building. The life safety devices communicate with each other using one or more wires. For example, one device can communicate a hazardous condition to one or more of the other devices of the system through using the wires running between devices.

At the same time as the wired life safety devices are installed, or at a later date, a life safety gateway device (e.g., gateway devices 222*c* and 500 described above) is installed in the system. The gateway device can replace an existing wired life safety device, or be added as a new life safety device. The gateway device is wired to one or more of the other life safety devices of the system. The gateway device can communicate with one or more of the wired life safety devices using the wires running between devices.

Next, one or more wireless life safety devices are installed in the building. The wireless safety devices can communicate with the gateway device using a wireless technology such as RF. In addition, the wireless safety devices can communicate indirectly with the wired devices through the gateway device.

For example, if a wireless safety device detects a hazardous condition, the wireless safety device can communicate the condition to the other wireless detectors and the gateway device using wireless communication. In addition, the wireless safety device can indirectly communicate the condition to the wired life safety devices through the gateway device.

In this manner, a system including a plurality of existing wired life safety devices can be supplemented with a gateway life safety device and one or more additional wireless life safety devices. The gateway life safety device can facilitate communications between the wired portion of the system and the wireless portion of the system.

In some embodiments, the gateway device can be used to replace an existing wired life safety device to add wireless capabilities to a system. In other embodiments, the gateway device can be added as a supplement device (e.g., wired to one or more existing wired life safety devices) to add wireless capabilities. In yet other embodiments, the gateway device can be a device that adds wireless capabilities to an existing wired life safety device.

The gateway device can be used in existing construction to supplement and add wireless capabilities. The gateway device can also be used in new construction where it may be desirable to provide a system having a hybrid of wired and wireless capabilities.

The above specification, examples and data provide a complete description of example embodiments made in accordance with the present invention. Since many embodiments of the invention can be made without departing from the spirit and scope of the invention, the invention resides in the claims hereinafter appended.

What is claimed is:

1. A system including a plurality of life safety devices, the system comprising:

a plurality of wired life safety devices configured to sense a hazardous condition, wherein each of the wired life safety devices is connected to one or more of the other wired life safety devices using one or more wires, and wherein each of the wired life safety devices communicates with one or more of the other wired life safety devices using the wires;

at least one wireless life safety device configured to sense the hazardous condition; and a gateway life safety device including a sensor configured to sense the hazardous condition, wherein the gateway life safety device is wired to at least one of the wired life safety devices, and wherein the gateway life safety device communicates with one or more of the wired life safety devices using the wires, and wherein the gateway life safety device communicates wirelessly with the wireless life safety device;

wherein the wired life safety devices communicate with the wireless life safety device through the gateway life safety device;

wherein the gateway life safety device enters a master mode if the gateway life safety device is in an alarm none mode and the life safety device senses the hazardous condition, the gateway life safety device sending out a wired alarm signal to the wired life safety device and a wireless alarm signal to the wireless life safety device, and the gateway life safety device remaining in the master mode until the gateway life safety device no longer senses the hazardous condition;

wherein the gateway life safety device enters a hardwire slave mode if the gateway life safety device is in the alarm none mode and the life safety device receives a wired interconnect signal from the wired life safety device, the gateway life safety device sending out the wireless alarm signal to the wireless life safety device, and the gateway life safety device remaining in the hardwire slave mode until the wired interconnect signal times out; and wherein the gateway life safety device enters a wireless slave mode if the gateway life safety device is in the alarm none mode and the life safety device receives a wireless interconnect signal from the wireless life safety device, the gateway life safety device sending out the wired alarm signal to the wired life safety device, and the gateway life safety device remaining in the wireless slave mode until the wireless interconnect signal times out.

2. The system of claim 1, wherein the gateway life safety device further comprises:

a battery configured to provide backup power;

an interconnect module configured to communicate the hazardous condition to the wired life safety devices using the wires; and a transceiver module configured to wirelessly communicate the hazardous condition to the wireless life safety device.

3. The system of claim 1, wherein the gateway life safety device further comprises an alarm module, wherein the gateway life safety device is configured to alarm using the alarm module when the gateway life safety device senses the hazardous condition.

4. The system of claim 1, wherein the hazardous condition is smoke or gas.

5. The system of claim 1, wherein the wires connecting the wired life safety devices and the gateway life safety device include a three-wire interconnect.

6. The system of claim 1, wherein the gateway life safety device is configured to receive a wired alarm signal from one of the wired life safety devices, wherein the gateway life safety device is configured to receive a wireless alarm signal from the wireless life safety device, and wherein the gateway life safety device is configured to alarm when the gateway life safety device receives either the wired alarm signal or the wireless alarm signal.

7. The system of claim 6, wherein the gateway life safety device is configured to send the wired alarm signal to the wired life safety devices when the gateway life safety device receives the wireless alarm signal from the wireless life safety device.

8. The system of claim 6, wherein the gateway life safety device is configured to send the wireless alarm signal to the wireless life safety device when the gateway life safety device receives the wired alarm signal from one of the wired life safety devices.

* * * * *